US006478614B1

(12) United States Patent
De'Longhi

(10) Patent No.: US 6,478,614 B1
(45) Date of Patent: Nov. 12, 2002

(54) EASY-DETACH ELECTRICAL CONNECTOR FOR KITCHEN APPLIANCE

(75) Inventor: Giuseppe De'Longhi, Treviso (IT)

(73) Assignee: De'Longhi S.p.A., Treviso (IT)

( * ) Notice: Subject to any disclaimer, the term of this patent is extended or adjusted under 35 U.S.C. 154(b) by 0 days.

(21) Appl. No.: 09/839,687

(22) Filed: Apr. 20, 2001

(51) Int. Cl.[7] ..... H01R 11/30; H01R 13/60; H01R 3/52; H01R 13/44

(52) U.S. Cl. ..... 439/519; 439/521; 439/139; 439/40

(58) Field of Search ..... 439/519, 587, 439/589, 170, 271, 660, 76.1, 79, 361, 559, 556, 954, 521, 134, 135, 136, 137, 138, 139, 140, 367, 38, 39, 40

(56) References Cited

U.S. PATENT DOCUMENTS 3,159,725 A * 12/1964 Dennis ..... 200/51.09
3,162,754 A * 12/1964 Jasionowski ..... 219/403
4,293,733 A * 10/1981 Royer ..... 174/67
4,669,791 A * 6/1987 Savill ..... 439/34
4,934,955 A * 6/1990 Taylor ..... 439/135
5,135,406 A * 8/1992 Ishikawa ..... 439/131
5,234,350 A * 8/1993 Marechal et al. ..... 439/139
5,495,402 A * 2/1996 Houssian ..... 362/226
5,505,630 A * 4/1996 Petrisko et al. ..... 439/137
5,666,829 A * 9/1997 Aikens ..... 70/57
5,669,776 A * 9/1997 Moody et al. ..... 439/138
5,669,781 A * 9/1997 Ishida ..... 439/326
5,816,825 A * 10/1998 Sekimori et al. ..... 439/39
5,873,737 A * 2/1999 Hashizawa et al. ..... 439/39
5,931,683 A * 8/1999 Pinel ..... 439/39
6,264,473 B1 * 7/2001 Bullinger et al. ..... 439/38
6,267,602 B1 * 7/2001 Mendelson et al. ..... 439/39

* cited by examiner

*Primary Examiner*—P. Austin Bradley
*Assistant Examiner*—Edwin A. León
(74) *Attorney, Agent, or Firm*—Herbert Dubno; Andrew Wilford

(57) ABSTRACT

The facilitated-detachment electrical connection device for kitchen appliances comprises an electrical cable exhibiting a connection plug to the electric network at one end, and a magnetised member electrically associable—through a magnetic force—to an outlet connected to the kitchen appliance at the opposed end, characterised in that it comprises insulation means present on said kitchen appliance and/or on said magnetised member for preventing the contact of condensate or the like with the electrical contacts of such magnetised member and of said outlet.

11 Claims, 2 Drawing Sheets

EASY-DETACH ELECTRICAL CONNECTOR FOR KITCHEN APPLIANCE

DESCRIPTION

Figure 1:
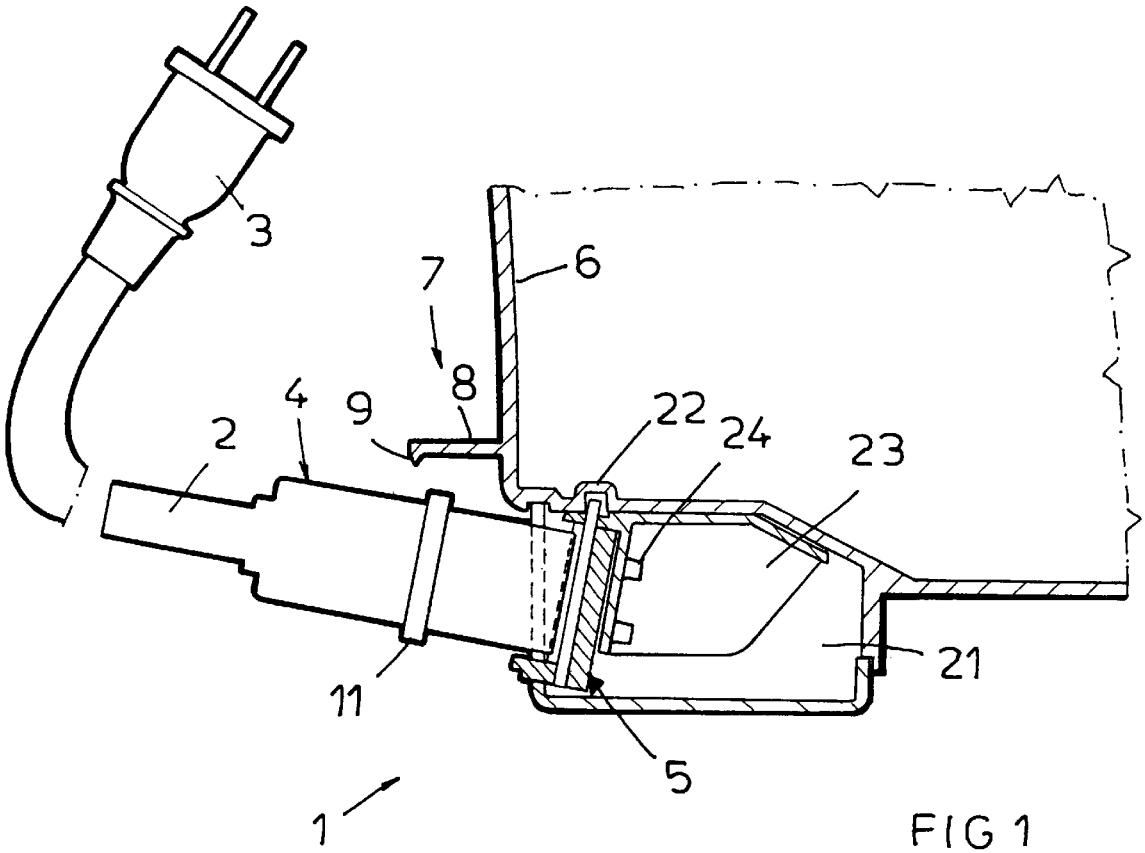

The present finding relates to a facilitated-detachment electrical connection device for kitchen appliances.

As known, current household appliances exhibit active and passive safety systems for the purposes of protecting as much as possible the users from accidents.

For this reason, current household appliances, and above all appliances that are used in the kitchen, exhibit several protection devices of the electrical parts, and safety devices adapted to prevent their opening of access to their interior during operation or soon after the same.

One of the problems currently present for household appliances, particularly those used in the kitchen, is that due to the fact that, for their operation, they almost always need the electrical connection with the electric network of the house or of the room they are arranged in.

For this reason sometimes, above all in the case of children, the electrical cable can be grasped thus allowing the electrical appliance to be dragged onto the work surface, for example a table, a shelf or the like, thus making the same fall on the child, with all the consequences arising from such action.

If, for example, the appliance is a deep-fryer, it is easy to understand how a child, pulling the electrical cable, can drag the same on its rest surface and, even during operation, tip it, with the possibility of oil leak, thus with unforeseeable and very dangerous consequences.

For this reason, electrical connectors have been devised, which use a magnetic force between a plug and an outlet as connection force.

In this case, if the electrical cable is pulled, there must occur the detachment between outlet and plug present on the electrical appliance to prevent the child from tipping it on himself.

However, above all for some electrical appliances such as deep-fryers, rice cookers, steam cookers, electrical grills, electrical plates and in general all household appliances for hot foodstuff, such application exhibits the disadvantage that a possible formation of condensate may penetrate between the electrical contacts of the appliance, thus causing a short circuit or other possible anomalies.

Moreover, above all for household appliances mainly realised with plastic material, exhibiting a low self-extinguishing power, the closeness with the electrical contacts can cause considerable disadvantages, such as the melting or self-combustion of the plastic, with the consequences that also in this case may arise from such situation.

Last but not least, it must be considered that the magnetic force of connection between plug and outlet must always be less than the friction force that generates between the electrical appliance and the rest surface, so as to allow the detachment of the plug from the outlet, thus preventing the possibility of dragging the appliance on the rest surface.

Object of the present finding is that of eliminating the above disadvantages of the prior art.

Within the scope of this object, an important purpose of the finding is that of realising a facilitated-detachment electrical connection device for kitchen- appliances which should be protected from possible infiltrations of condensate or the like, so as to prevent short circuits or other operation anomalies.

Another purpose of the finding is that of realising a facilitated-detachment electrical connection device wherein the magnetic force of electrical connection should be less than the friction force for dragging the appliance on the rest surface of the same irrespective of the direction in which the cable is pulled.

Another purpose of the finding is that of realising a facilitated-detachment electrical connection device for kitchen appliances which, should the latter exhibit parts made of a plastic material with a low self-extinguishing power, should prevent the melting of the same or the combustion of the same due to the closeness of the electrical contacts.

Last but not least, another purpose of the finding is that of realising a facilitated-detachment electrical connection device for kitchen appliances which should be very stout and with a regular operation in time without exhibiting any mechanical or electrical disadvantage.

This object, as well as these and other purposes, are achieved by a facilitated-detachment electrical connection device for kitchen appliances comprising an electrical cable exhibiting a connection plug to the electric network at one end, and a magnetised member electrically associable—through a magnetic force—to an outlet connected to the kitchen appliance at the opposed end, characterised in that it comprises insulation means present on said kitchen appliance and/or on said magnetised member for preventing the contact of condensate or the like with the electrical contacts of such magnetised member and of said outlet.

Figure 1A:
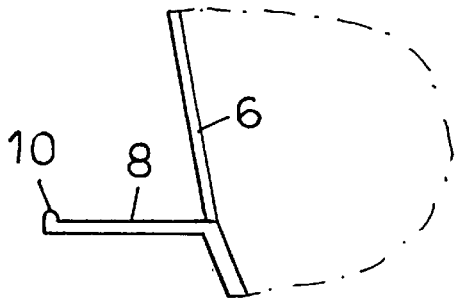
Figure 2:
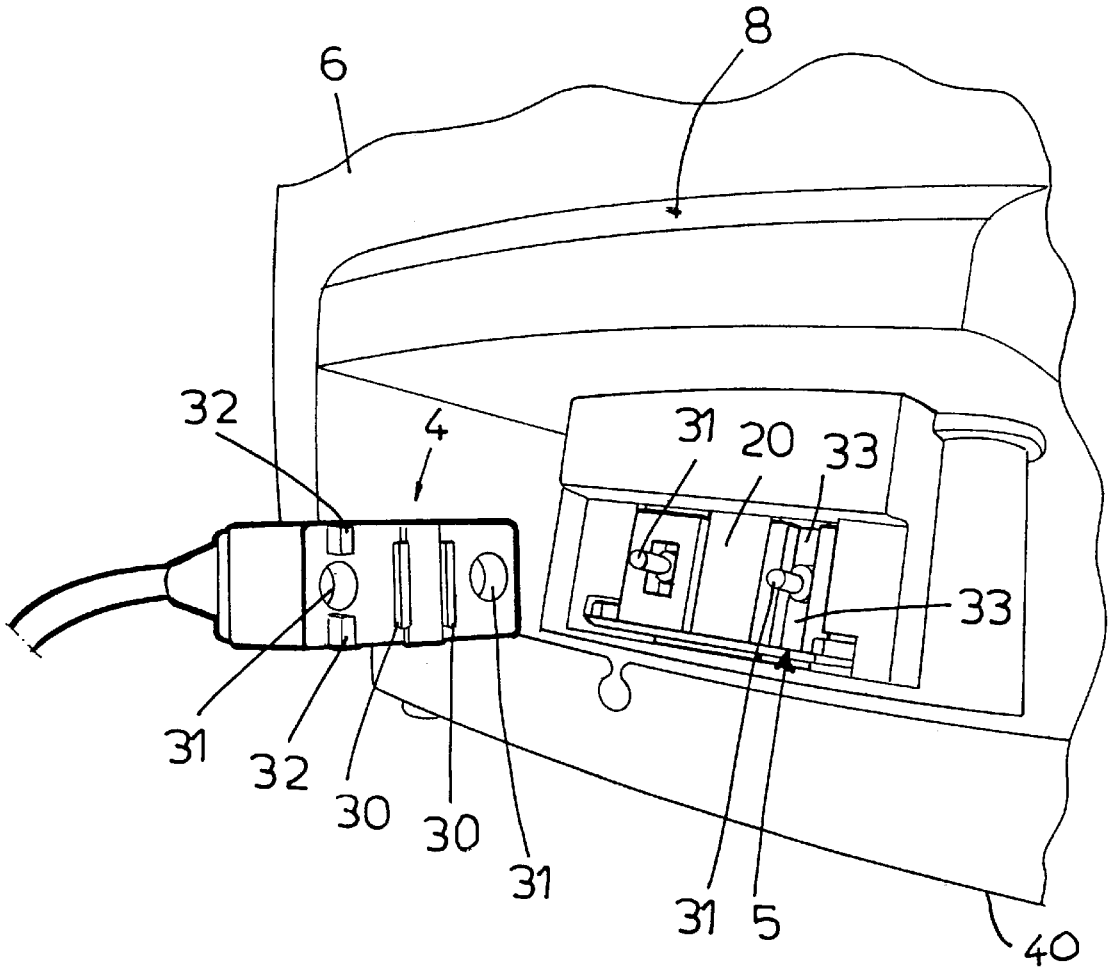

Further features and advantages of the present invention will appear more clearly from the description of a preferred but not exclusive embodiment of the device according to the finding, illustrated by way of a non-limiting example in the attached drawings. In such drawings:

FIG. 1 shows a schematic side elevation sectioned view of the device according to the finding;

FIG. 1*a* shows an enlarged view of the shelf according to the finding;

FIG. 2 shows a perspective partial view of the device according to the finding applied to a deep-fryer.

With reference to the above figures, the facilitated-detachment electrical connection device for kitchen appliances, collectively indicated with reference numeral 1, comprises an electrical cable 2 exhibiting a plug 2 for the connection to the electric network at one end, and a magnetised member, collectively indicated with reference numeral 4, at the opposed end.

The magnetised member is electrically associable through a magnetic force to an outlet, generically indicated with reference numeral 5, connected to the kitchen appliance 6, in the case taken as an example defined by a deep-fryer for cooking foodstuff in boiling oil.

Advantageously, the device comprises insulation means, collectively indicated with reference numeral 7, that is present on the kitchen appliance 6 and/or on the magnetised member 4 for preventing the contact of condensate or liquids or other similar products with the electrical contacts of the magnetised member and of the outlet.

In particular, the insulation means comprises a shelf 8 arranged adjacent the magnetised member 4.

In particular, shelf 8 develops outside the body of the kitchen appliance which, in the case taken as an example, is made for example of a plastic material having a low self-extinguishing power for limiting the deep-fryer production costs.

Shelf 8 is arranged on the upper side of the magnetised member and of the outlet, and it comprises a drop breaker 9 on its outside edge.

In a construction variant, shelf 8 can also be inclined both with respect to surface 6 of the deep-fryer body, and laterally to the magnetised member so as to discharge on its side the possible condensate formation.

In another variant, the shelf—as represented in figure 1*a*—besides the inclination with respect to body 6, can also be provided with a thickening 10 developing on the outside edge so as to prevent the condensate from falling on the magnetised body and convey it laterally to the same.

Moreover, the insulation means comprises a relief 11 arranged on the magnetised member 4 for deviating the condensate, in co-operation with shelf 8, laterally to the magnetised member.

The relief can develop only upwards or sidewards or externally on the magnetised member, so as to create a barrier to the flowing of liquid or condensate towards the electrical contacts.

Outlet 5 comprises a metal plate 20 adapted to determine the magnetic connection with the magnetised member 4.

Moreover, outlet 5 is arranged into a housing 21 obtained into body 6 of the appliance, in particular of the deep-fryer.

Into housing 21 there are present means for holding the metal plate, which for example is defined by a recess 22 into which the upper end of the metal plate wedges.

In this way, there is the dual advantage of determining the hold of outlet 5 into housing 21, and at the same time, maintaining the metal plate 20 connected to outlet 5 without making the connection between the two elements depend only on the adhesive between them.

Moreover, into housing 21 there is arranged a case 23 for outlet 5.

Case 23 is advantageously realised with a material exhibiting a high self-extinguishing power, so that the electrical contacts 24 of the outlet, even though they are maintained close to the plastic body, cannot create disadvantages to the latter.

In this way, it is possible to maintain housing 21 at small size, without enlarging the machine body and at the same time, produce the latter with poor plastic material with low self-extinguishing power but not expensive.

To make the magnetised body 4 easily detach, according to the needs, from outlet 5, even if cable 2 is pulled along any direction, the arrangement of the magnetised body 4 and of outlet 5 into housing 21 is inclined also with respect to the rest surface of the deep-fryer.

In this way, when cable 2 is pulled along any direction, between the magnetised body 4 and outlet 5 there occurs a resolution of forces that facilitates the detachment of the two elements.

In fact, the magnetised member 4 comprises at least one magnetic portion 30 associable to the metal plate 20 and at least two electrical contacts 31 arranged laterally to the magnetic portion 30.

Moreover, the magnetised member comprises spacers 32 and respective recesses 33 to allow the correct matching of the electrical contacts between the magnetised body with those of the outlet.

Moreover, it must be noted that the kitchen appliance, in this case the deep-fryer, exhibits a contact surface on the rest surface 40 defined by anti-friction strips of feet made of a plastic material.

Such contact surface is sufficiently extended to generate a friction force that is at least 5% more than the magnetic connection force between the magnetised member and the outlet, so as to determine, jointly with the inclination of these two elements into housing 21, an easy detachment, thus preventing the dragging of the deep-fryer along the rest surface, and preventing it from falling.

The operation of the device according to the finding is evident from what described and illustrated.

In practice, it has been proved that the device according to the finding is particularly advantageous since it allows an easy detachment when needed between the appliance body and the electrical contacts, and it prevents possible formations of condensate or the like from penetrating into the electrical contacts thus causing serious damage of operation anomalies.

Moreover, the electrical contacts are protected by a case made of a resistant material exhibiting a high self-extinguishing power, which allows reducing the spaces and using poor plastic materials with a low cost.

The finding thus conceived can be subject to several changes and variants, all falling within the scope of the inventive idea.

Moreover, all details can be replaced with technically equivalent details.

In practice, the materials used as well as the sizes can be of any type according to the requirements and to the prior art.

What is claimed is:

1. An easy-detach electrical connector for a kitchen appliance, the connector comprising:

an electrical cable having a plug end adapted to be connected to line and an opposite connector end forming a pair of contacts;

an outlet on the appliance, having a pair of contacts engageable with the contacts of the cable, and having a magnetically attractable part;

a magnetized member carried on the connector end and capable of clinging magnetically to the outlet part with the cable contacts engaging the outlet contacts;

means including a deflector shelf on the appliance body above the outlet positioned to deflect liquid away from the outlet and a deflector formation on the magnetized member positioned to deflect liquid away from the cable contacts for deflecting descending liquid condensate away from the contacts.

2. The easy-detach kitchen-appliance electrical connector defined in claim 1 wherein the shelf has an outer edge formed with a drip-breaking edge.

3. The easy-detach kitchen-appliance electrical connector defined in claim 1 wherein the shelf is inclined to conduct condensate laterally from the outlet.

4. The easy-detach kitchen-appliance electrical connector defined in claim 1 the shelf has an upwardly projecting thickened outer edge.

5. The easy-detach kitchen-appliance electrical connector defined in claim 1 wherein the deflector formation is an outwardly projecting ridge on the magnetized member.

6. The easy-detach kitchen-appliance electrical connector defined in claim 1 wherein the part of the outlet is a metal plate, the appliance having a housing interfitting complementarily with the plate.

7. The easy-detach kitchen-appliance electrical connector defined in claim 1 wherein the housing has a body made of a material with a high self-extinguishing power.

8. The easy-detach kitchen-appliance electrical connector defined in claim 1 wherein the outlet and the magnetic body when clinging to the part extend at an angle to a surface on which the appliance is resting.

9. The easy-detach kitchen-appliance electrical connector defined in claim 8 wherein the magnetized member includes a magnet flanked by the pair of cable contacts, the magnetized member and the outlet being formed with complementary interengaging bumps and recesses that fit together when the cable contacts are engaged with the outlet contacts.

10. The easy-detach kitchen-appliance electrical connector defined in claim 1 wherein the appliance is a deep-fryer.

11. The easy-detach kitchen-appliance electrical connector defined in claim 1 wherein the magnetized member clings magnetically to the outlet with a force smaller than a force needed to overcome static friction between the appliance and a surface on which the appliance is resting.

* * * * *